US008082972B1

(12) United States Patent
Phipps

(10) Patent No.: US 8,082,972 B1
(45) Date of Patent: Dec. 27, 2011

(54) SYSTEM FOR ASSEMBLY WAX TREES USING FLEXIBLE BRANCH

(75) Inventor: Bruce Phipps, Millbrook, NY (US)

(73) Assignee: MPI Incorporated, Poughkeepsie, NY (US)

( * ) Notice: Subject to any disclaimer, the term of this patent is extended or adjusted under 35 U.S.C. 154(b) by 0 days.

(21) Appl. No.: 12/898,099

(22) Filed: Oct. 5, 2010

(51) Int. Cl.
*B22C 7/02* (2006.01)
*B22C 9/04* (2006.01)

(52) U.S. Cl. ..... 164/35; 164/45; 164/516

(58) Field of Classification Search ..... 164/34–36, 164/45, 516–519
See application file for complete search history.

(56) References Cited

U.S. PATENT DOCUMENTS

| | | | |
|---|---|---|---|
| 4,180,119 | A | 12/1979 | Burd et al. |
| 5,056,999 | A | 10/1991 | Lewis et al. |
| 5,247,984 | A | 9/1993 | Stanciu |
| 5,296,308 | A | 3/1994 | Caccavale et al. |
| 5,977,007 | A | 11/1999 | Lassow et al. |
| 5,983,982 | A | 11/1999 | Vihtelic et al. |
| 6,481,490 | B1 | 11/2002 | Vihtelic et al. |
| 6,497,272 | B1 | 12/2002 | Maslen |
| 6,505,672 | B2 | 1/2003 | Mertins |
| 6,505,678 | B2 | 1/2003 | Mertins |
| 6,626,230 | B1 | 9/2003 | Woodrum et al. |
| 6,719,036 | B2 | 4/2004 | Mertins |
| 6,749,006 | B1 | 6/2004 | Yang et al. |
| 6,789,604 | B2 | 9/2004 | Mertins |
| 6,845,811 | B2 | 1/2005 | Yang et al. |
| 6,889,743 | B2 | 5/2005 | Mertins |
| 6,910,519 | B2 | 6/2005 | Ludwig et al. |
| 6,929,050 | B2 | 8/2005 | Puffer, Jr. et al. |
| 6,957,686 | B2 | 10/2005 | Puffer, Jr. et al. |
| 6,986,949 | B2 | 1/2006 | Mertins |
| 7,124,037 | B2 | 10/2006 | Gardener |
| 7,147,307 | B2 | 12/2006 | Silverbrook |
| 7,264,036 | B2 | 9/2007 | Chang et al. |
| 7,270,166 | B2 | 9/2007 | Jakus et al. |
| 7,290,584 | B2 | 11/2007 | Hedrick et al. |
| 7,302,991 | B2 | 12/2007 | Chang et al. |
| 7,302,992 | B2 | 12/2007 | Chang et al. |
| 2003/0066619 | A1 | 4/2003 | Mertins |
| 2008/0035295 | A1 | 2/2008 | Jakus et al. |

*Primary Examiner* — Kuang Lin
(74) *Attorney, Agent, or Firm* — Heslin Rothenberg Farley & Mesiti P.C.

(57) ABSTRACT

A process for creating a lost wax tree, including the steps of assembling a wax tree having a wax pattern and a wax runner, using automated equipment to flex either the wax tree or the wax pattern to bring disconnected sections into proximity, heating at least one of the disconnected sections, contacting the disconnected sections and then moving the sections slightly away from one another. A process for casting a part including the steps of creating a lost wax tree and where the wax tree is later covered with a mold material and the wax tree is removed to create a mold, the mold is then used to cast a part similar to the wax pattern. A lost wax tree having a wax tree with a wax pattern and a wax runner, automated equipment for flexing, a heating element, and automated equipment for manipulating disconnected sections.

20 Claims, 15 Drawing Sheets

SYSTEM FOR ASSEMBLY WAX TREES USING FLEXIBLE BRANCH

TECHNICAL FIELD

This invention relates generally to the field of lost wax processing of castings and more specifically, to the field of wax tree assembly.

BACKGROUND OF THE INVENTION

A casting may be created by the lost wax process, in which a wax pattern is formed by injection molding. One or more wax patterns are then attached to a runner, creating a wax tree assembly. A ceramic or other mold material is then spread over the wax tree assembly to create a shell, which acts as a mold. The shell is then heated to remove the wax. A molten material such as a metal is then poured into the ceramic shell and allowed to harden. The ceramic is then broken away and the castings removed from the runner.

The lost wax process is highly labor intensive even though wax pattern production, ceramic buildup and metal pouring have been successfully automated; the assembly of wax trees must be accomplished largely by hand. This is particularly true where wax tree assemblies are large and complex, involving a large number of parts. Large and complex wax patterns also require skilled and artistic wax tree assemblers.

The complexity of wax trees has made it desirable to create wax runners out of more than one piece of wax. It may also be necessary to move different pieces of the wax runner or the wax pattern in order to create a more accurate final casting.

Accordingly, a process for connecting different pieces of a wax runner together to form a single wax tree is desirable. A process of adapting a wax runner or wax pattern from a first position to a second position in creating a lost wax tree is also desirable.

SUMMARY OF THE INVENTION

The invention provides, in a first aspect, a process for creating a lost wax tree, including, assembling a wax tree having at least a wax pattern of a part and a wax runner, using automated equipment to flex either the wax pattern, the wax runner, or both, to bring the disconnected sections of the wax tree into proximity with each other without damaging the wax tree, heating at least one of the disconnected sections, and contacting the disconnected sections after heating and moving the disconnected sections slightly away from one another. In one embodiment, the flexing step includes flexing a wax runner. In another embodiment, the flexing step includes flexing the wax pattern. In another embodiment, the flexing step includes either bending, stretching or both. In one embodiment, the heating step may be performed using automated equipment. In another embodiment, the heating step includes heating at least one of the disconnected sections to soften either the wax pattern, the wax runner or both, to allow flexing to occur at the softened sections. In another embodiment, the heating step includes heating the ends of the disconnected sections and contacting the heated ends together to assemble a wax tree. In another embodiment, the contacting and moving steps are performed using automated equipment.

The invention provides, in a second aspect, a process for casting a part using a lost wax tree, which may include, assembling a wax tree, the wax tree having a wax pattern of the part and a wax runner, using automated equipment to flex the wax pattern, the wax runner or both, to bring disconnected sections of the wax tree into proximity with each other without damaging the wax tree, heating at least one of the disconnected sections, contacting the disconnected sections after heating and then moving the disconnected sections slightly away from one another, where the wax tree is later covered with a mold material and the wax tree is removed from the mold material to create a mold, and the mold is later used to cast a part similar to the wax pattern. In another embodiment, the flexing step includes flexing of the wax runner. In another embodiment, the flexing step may include flexing the wax pattern. In another embodiment, the flexing includes bending, stretching, or both. In another embodiment, the heating step is performed using automated equipment. In another embodiment the heating step includes heating at least one of the disconnected sections to soften either the wax pattern or the wax runner or both, to allow flexing to occur at the softened sections. In another embodiment, the heating step includes heating the ends of the disconnected sections and contacting the ends together to assemble the wax tree. In another embodiment, the contacting and moving steps may be performed using automated equipment.

The invention provides, in another aspect, a lost wax tree system, including a wax tree having at least a wax pattern to be cast and a wax runner, automated equipment means for flexing either the wax pattern, the wax runner or both to bring disconnected sections of the wax tree into proximity with each other without damaging the wax tree, a heating element oriented to heat at least one of the disconnected sections, and automated equipment means for contacting the disconnected sections after heating and then moving the disconnected sections slightly away from one another to assemble the wax tree. In one embodiment, the automated equipment means for flexing flexes the wax runner. In another embodiment, the automated equipment means for flexing flexes the wax pattern. In another embodiment, the automated equipment means for flexing and the equipment means for contacting include a robot.

Other additional features and benefits will become apparent from the following drawings and descriptions of the invention. Other embodiments and aspects of the invention are described in detail herein and are considered a part of the claimed invention.

BRIEF DESCRIPTION OF THE DRAWINGS

The subject matter which is regarded as the invention is particularly pointed out and distinctly claimed in the claims at the end of the specification. The foregoing and other objects, features, and advantages of the invention are apparent from the following detailed description taken in conjunction with the accompanying drawings in which:

DETAILED DESCRIPTION FOR CARRYING OUT THE INVENTION

Figure 1:
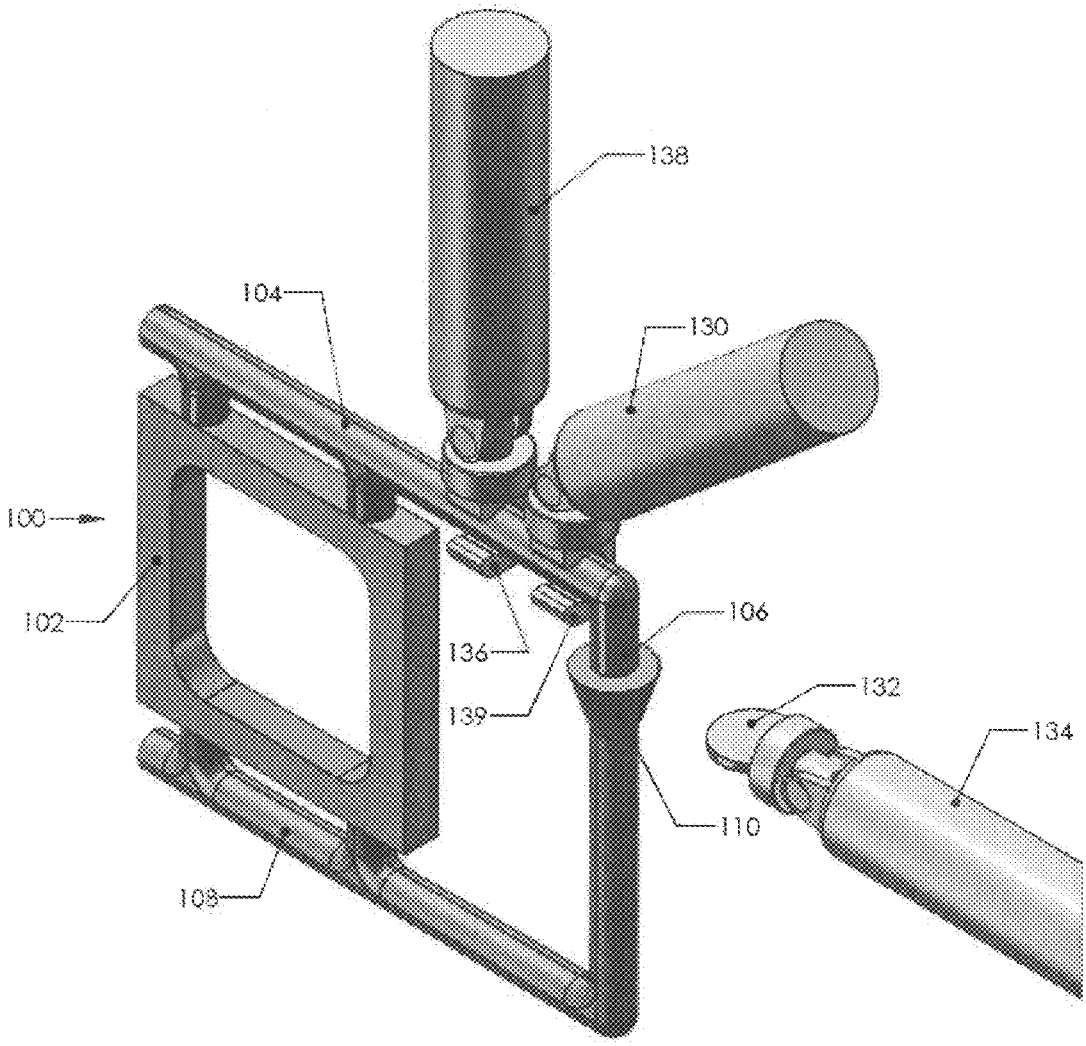
FIG. 1 depicts an isometric view of a wax tree, where disconnected sections are in proximity with one another, in accordance with an aspect of the invention.

For the purposes of promoting an understanding of the principles of the process for casting a part using a lost wax tree, process for creating a lost wax tree, and lost wax tree system, reference will now be made to the embodiments, or examples, illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which process for creating a lost wax tree, the process for casting a part using a lost wax tree, and lost wax tree system invention relates.

Generally stated, disclosed herein is a system and process for casting a part using a lost wax tree, a process for creating a lost wax tree, and a lost wax tree system. The process for casting a part using a lost wax tree may include, generally, assembling a wax tree, the wax tree having a wax pattern of the part and a wax runner, using automated equipment to flex the wax pattern, the wax runner or both, to bring disconnected sections of the wax tree into proximity with each other without damaging the wax tree, heating at least one of the disconnected sections, contacting the disconnected sections after heating and then moving the disconnected sections slightly away from one another. The wax tree is later covered with a mold material such as ceramic and the wax tree is removed from the mold material to create a mold. The mold is later used to cast a part similar to the wax pattern. The process for creating a lost wax tree includes, generally, assembling a wax tree having at least a wax pattern of a part and a wax runner, using automated equipment to flex either the wax pattern, the wax runner, or both, to bring the disconnected sections of the wax tree into proximity with each other without damaging the wax tree, heating at least one of the disconnected sections, and contacting the disconnected sections after heating and moving the disconnected sections slightly away from one another.

A lost wax tree system, generally includes a wax tree having at least a wax pattern to be cast and a wax runner, automated equipment means for flexing either the wax pattern, the wax runner or both, to bring disconnected sections of the wax tree into proximity with each other without damaging the wax tree, a heating element oriented to heat at least one of the disconnected sections, and automated equipment means for contacting the disconnected sections after heating and then moving the disconnected sections slightly away from one another to assemble the wax tree.

A complete disclosure of automated equipment capable of assembling lost wax trees is included in U.S. Pat. No. 6,910,519 to Ludwig et. al. on Jun. 25, 2005, and is hereby incorporated by reference in its entirety. Such automated equipment is useable in the present invention to heat and/or move sections of a wax tree.

The following description of the process of creating a lost wax tree should be understood to equally apply to a process for casting a part using a lost wax tree, as both processes are related. For each embodiment of the process for creating a lost wax tree, the process for casting a part using a lost wax tree should be understood to include the step of later covering the wax tree with a mold material, removing the wax tree from the mold material, thereby creating a mold, the mold later being used to cast a part similar to the wax pattern.

A wax tree typically contains one or more wax patterns which are in the shape of a part to be cast typically using a metal as the part material. The wax patterns are connected to one or more wax runners which together form a wax tree. The wax tree is typically covered with a material such as ceramic after the wax tree is fully assembled. After the ceramic is finally formed over the wax tree and hardened, the wax tree, which is now located within the inside the ceramic, is melted so that the wax is removed from the inside of the ceramic material. The resultant hollow ceramic material forms a mold. The ceramic material is then used to cast a part in the shape of the wax pattern. Molten material such as metal is flowed into the ceramic material through a pour cup formed as a section of the ceramic mold. The flow area of the molten material is defined by the wax tree previously assembled, but removed from within the ceramic material. The wax pattern of the wax tree defines the shape of the parts to be cast while the wax runners define the flow path of the molten material to the wax pattern and the pour cup where the molten material is poured into the ceramic. In addition, the wax tree defines a vent where air from within the ceramic material vented from within the ceramic material to allow the molten metal to flow through the ceramic material. Thus, the wax tree includes a wax joint and (shown as 110 in FIG. 1) a wax runner which forms a bottom feed of the wax tree (shown as 108 in FIG. 1), a wax pattern (shown as 102 in FIG. 1) and top feed (shown as 104 in FIG. 1) which forms the mold. The wax tree is formed so that the lower part is larger than the upper part such that parts can be connected together using a dip and pull technique described herein so a suitable weld can be formed.

Referring now to FIG. 1, a disassembled wax tree 100 is shown. The disassembled wax tree includes various sections including a wax pattern 102, and a first wax runner 104, with a disconnected section 106, and a second wax runner 108, with a disconnected section 110. FIG. 1 shows the disconnected section 106 and disconnected section 110 in proximity. Some of the various sections may be pre-assembled prior to final assembly. To facilitate assembly of the wax tree, these parts may have been placed in proximity by hand or with automated equipment, such as a robot 130. Disconnected section 106 and disconnected section 110 may be in contact as shown in FIG. 1, or may not be in contact as later described herein. A first heating element 132 may be in proximity to disconnected section 106 and disconnected section 110. Heating element 132 may be controlled by automated equipment, such as a robot or linear actuator 134. In an alternative embodiment, heating element 132 may be controlled manually. A second heating element 136 may be in proximity to wax runner 104. Heating element 136 may be controlled by automated equipment such as robot, such as a robot 138, or, in alternative embodiments, may be controlled manually. It is also contemplated that heating element 136 may be in proximity to wax pattern 102 or wax runner 108. It is also contemplated that one or more heating elements 136 may be in proximity to wax tree 100. It is contemplated that, where more than one heating element 136 is present, they may be located in proximity to wax runner 104, wax runner 108 and wax pattern 102, or any sub-combination thereof.

The components shown in FIG. 1 are useable in a system for assembling wax trees in accordance with the present invention. The system utilizes automated equipment such as robot 138, robot 130, and robot 134 for assembly of a wax tree. Robot 134 is used to manipulate a heating element 132 which is used to heat one or more ends of disconnected sections of a wax runner. Robot 130 is used to manipulate a holder, clamp, or other mechanism 139 which secures a branch of the wax tree, such as, for example, a wax runner section, for movement thereof. Robot 138 is also used to manipulate a heating element 136 which may heat a different portion of the wax tree and robot 134. Alternatively, although is not shown in the drawings, a single robot, such as robot 138, may contain arms or mechanisms which are moveable in sufficient locations so as to heat multiple locations of the wax tree such as portions to be flexed as well as disassembled ends 106 and 110 of the wax tree. Accordingly, in accordance with the invention, either one or more robotic mechanisms may be used to manipulate positions of sections of the wax tree and/or heat sections of the wax tree as well. Prior to final assembly of a wax tree, sections of the wax tree may be brought into proximity with one another such as shown in FIG. 1. In accordance with the present invention, the automated equipment may be used to flex and/or heat sections of the wax tree for final assembly thereof. The wax runner or wax pattern may be flexed, and/or both may separately and/or simultaneously flexed.

Figure 2A:
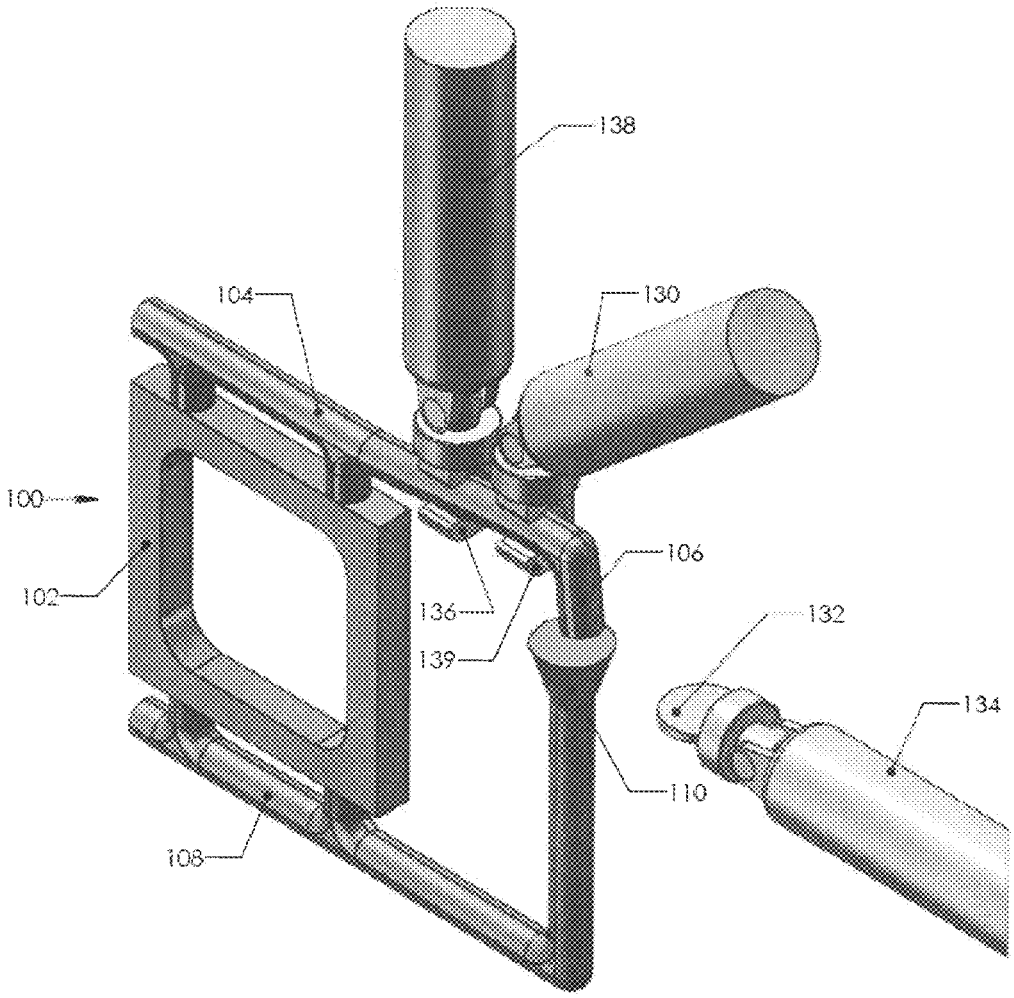
FIG. 2A depicts an isometric view of the wax tree of FIG. 1, where a wax runner has been flexed, in accordance with an aspect of the invention.
Figure 2B:
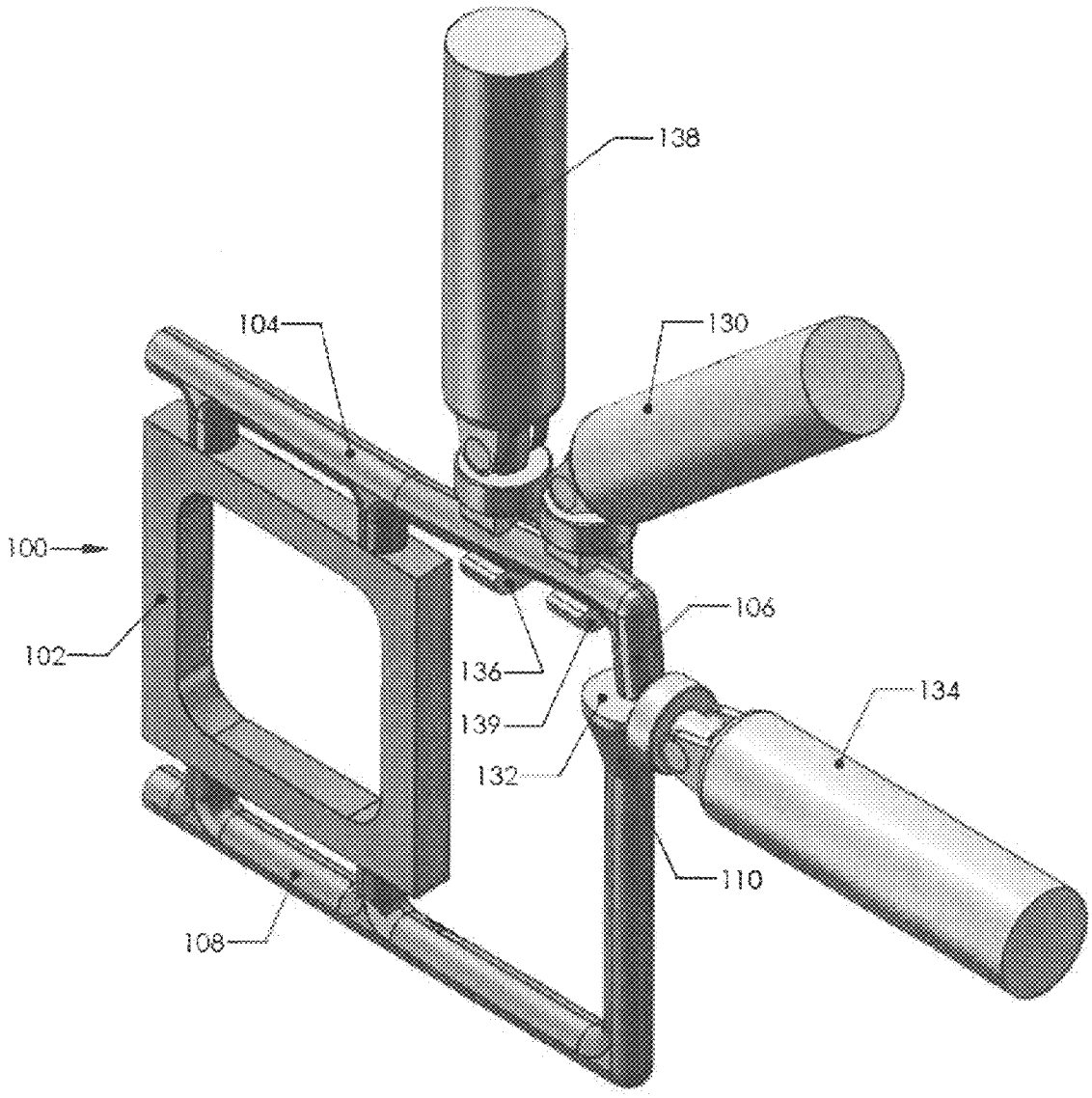
FIG. 2B depicts an isometric view of the wax tree of FIG. 1, where a robot has inserted a heating element between the disconnected sections of the wax tree.

Assembly of a disconnected wax tree will now be described. Referring now to FIGS. 2A and 2B, wax runner 104 may be flexed, either by hand or, preferably, with automated equipment, such as robot 130. Robot 130 engages wax runner 104 using its gripper mechanism 139 to allow wax runner 104 into a different position to allow for assembly of the wax tree. Specifically, robot 130 moves wax runner 104 so that disconnected section 106 is moved away from and further spaced from disconnected section 110. The flexing step shown in FIGS. 2A and 2B, includes bending of the wax runner 104, which occurs without breakage or damage to wax tree 100. In order to facilitate the flexing of the wax runner 104 by robot 130, the automated equipment may include a heating element 136. The heating element 136 may be used to heat the wax runner 104, if necessary, at the section where flex is desired. Also, disconnected section 106 and/or disconnected section 110 may also be heated by heating element 132. Heating element 132 may be positioned or advanced using linear actuator 134 such that it is located between disconnected section 106 and disconnected section 110 to heat the ends thereof. Heating element 132 may be advanced by other automated equipment, or may be manually manipulated. Heating element 132 may be heated before and/or after it is located between disconnected section 106 and disconnected section 110. Heating element 132 may thus heat the end of disconnected section 106 and/or the end of disconnected section 110 to soften said ends to facilitate connected the softened ends together, e.g., forming a wax weld therebetween.

Figure 3:
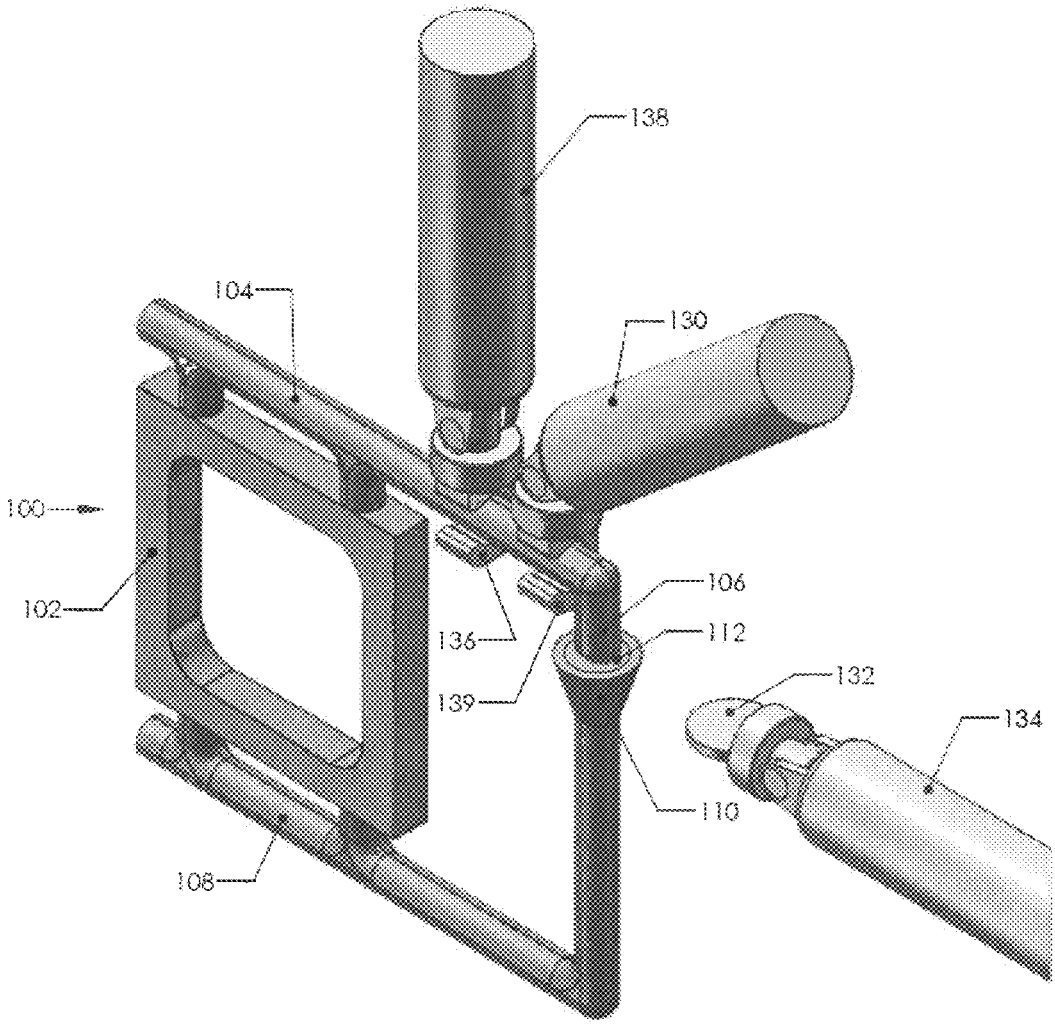
FIG. 3 depicts the wax tree of FIG. 1, where the disconnected sections have been connected and then have been moved slightly away from one another, in accordance with an aspect of the invention.

To assemble the wax tree, disconnected section 110 and disconnected section 106 are then brought into contact, as shown in FIG. 3, using robot 130. Section 110 and section 106 are then connected to each other while softened and then moved slightly away from one another, and a fillet weld 112 therebetween is allowed to form. Any other type of weld associated with lost wax trees such as, for example purposes, a tee weld, a flange weld, a square weld or a single-bevel weld may also be heated between sections 106 and 110. Such welds may be created by the use of automated equipment 130, namely, robots, and heating elements. The process for creating the fillet weld 112 is disclosed in U.S. Pat. No. 6,910,519 issued on Jun. 28, 2005, which is hereby incorporated by reference herein in its entirety and useable with the present invention. As set forth therein, automated equipment is used to heat the ends of one or more of the disconnected sections to soften the ends. Weld 112 as shown in FIG. 3 is a rounded concave bead between wax runner 108 and wax runner 104.

Referring again to FIG. 1, disconnected section 106 and disconnected section 110 may be aligned with one another such that fusion therebetween may subsequently occur. A heating element 132 may then be used to heat disconnected section 106 and/or disconnected section 110 as shown in FIG. 2. Heating element 132 may be placed between or in proximity, e.g., in between, disconnected section 106 and/or disconnected section 110, and their respective ends which face each other. In alternative embodiments, heating element 132 may be a torch, a heat gun, a heated blade or other known means of heating a wax pattern. It is also contemplated that heating element 132 may be placed in contact with disconnected section 106 and/or disconnected section 110. In other embodiments disconnected section 106 and disconnected section 110 may be prepared with a bonding procedure before connection with each other. For example, a sticky wax or other substance may be applied to disconnected section 106 and/or disconnected section 110 to facilitate their connection together.

Referring again to FIG. 3, after disconnected section 106 and/or disconnected section 110 are heated to a sufficient temperature, heating element 132 may be withdrawn and disconnected section 110 and disconnected section 106 are brought into contact with one another using automated equipment 130. Preferably, at least one of disconnected section 106 and disconnected section 110 is still soft or molten when they are brought into contact with one another. Wax runner 104 may be heated by heating element 136 to facilitate flexing. Robot 130 holds the wax tree section and manipulates the wax tree and flexes wax runner 104 to bring disconnected section 106 into contact with disconnected section 110. After disconnected section 106 and disconnected section 110 are brought into contact with one another, disconnected section 106 and disconnected section 110 are then slightly separated from one another by the automated equipment 130, thereby creating filled weld 112. Disconnected section 106 and disconnected section 110 may be separated slightly by automated equipment 130 or by manual movement of wax runner 104. The wax is then allowed to harden and solidify.

Generally, only a slight separation such as approximately within a general range of ten one thousandths of an inch to sixty one thousandths of an inch, depending on the size of wax runner 104 and wax runner 108, is necessary to create a filled weld 112. The process for creating a weld 112 may also be performed by hand, but preferably is performed by the automated equipment. The wax runner 104 may be substantially returned to its pre-flex position, similar to the position shown in FIG. 1, after weld 112 has been formed.

Figure 4A:
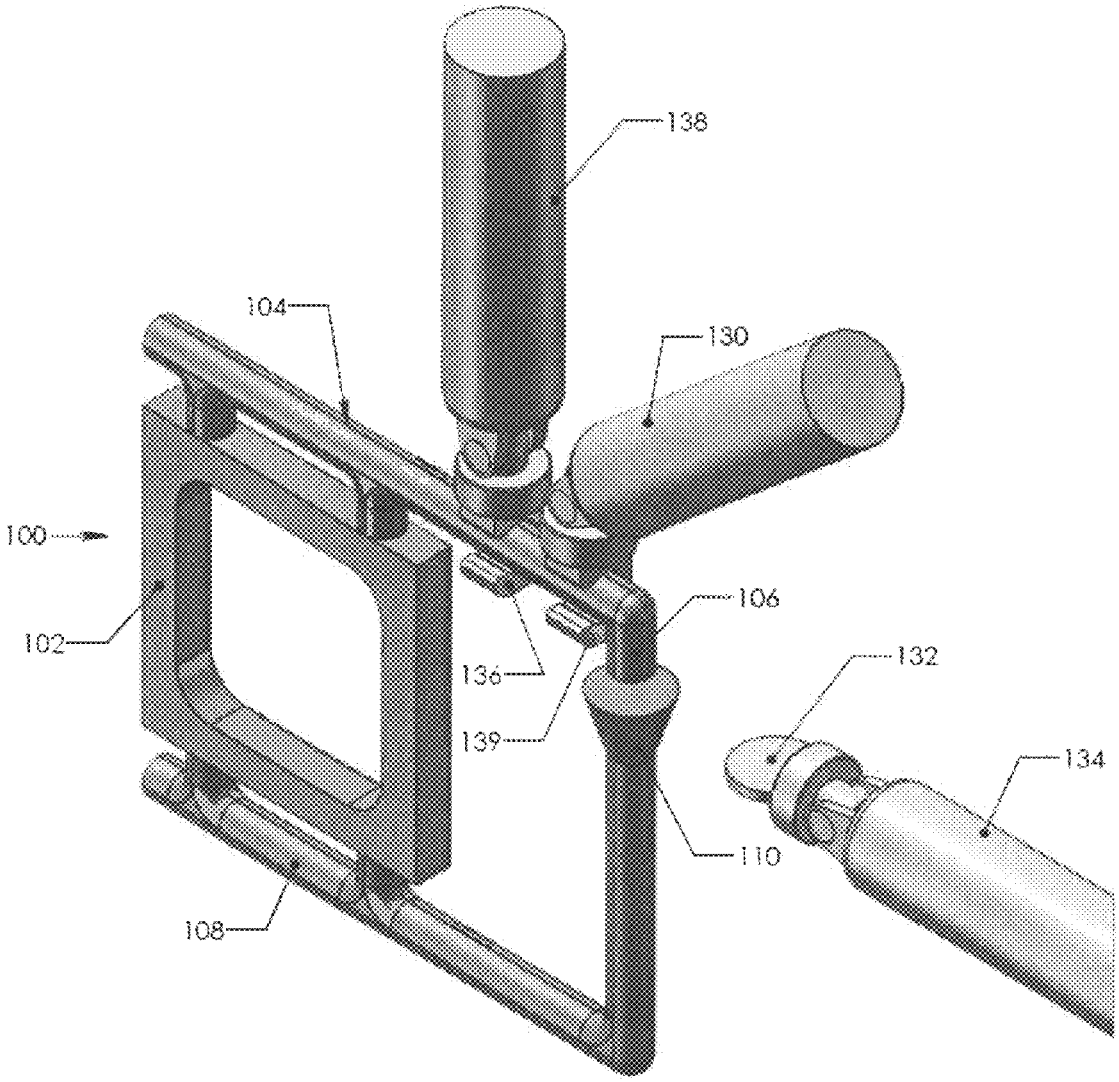
FIG. 4A depicts an isometric view of another embodiment of a wax tree, where disconnected sections are in proximity but are not in contact with one another, in accordance with an aspect of the invention.
Figure 4B:
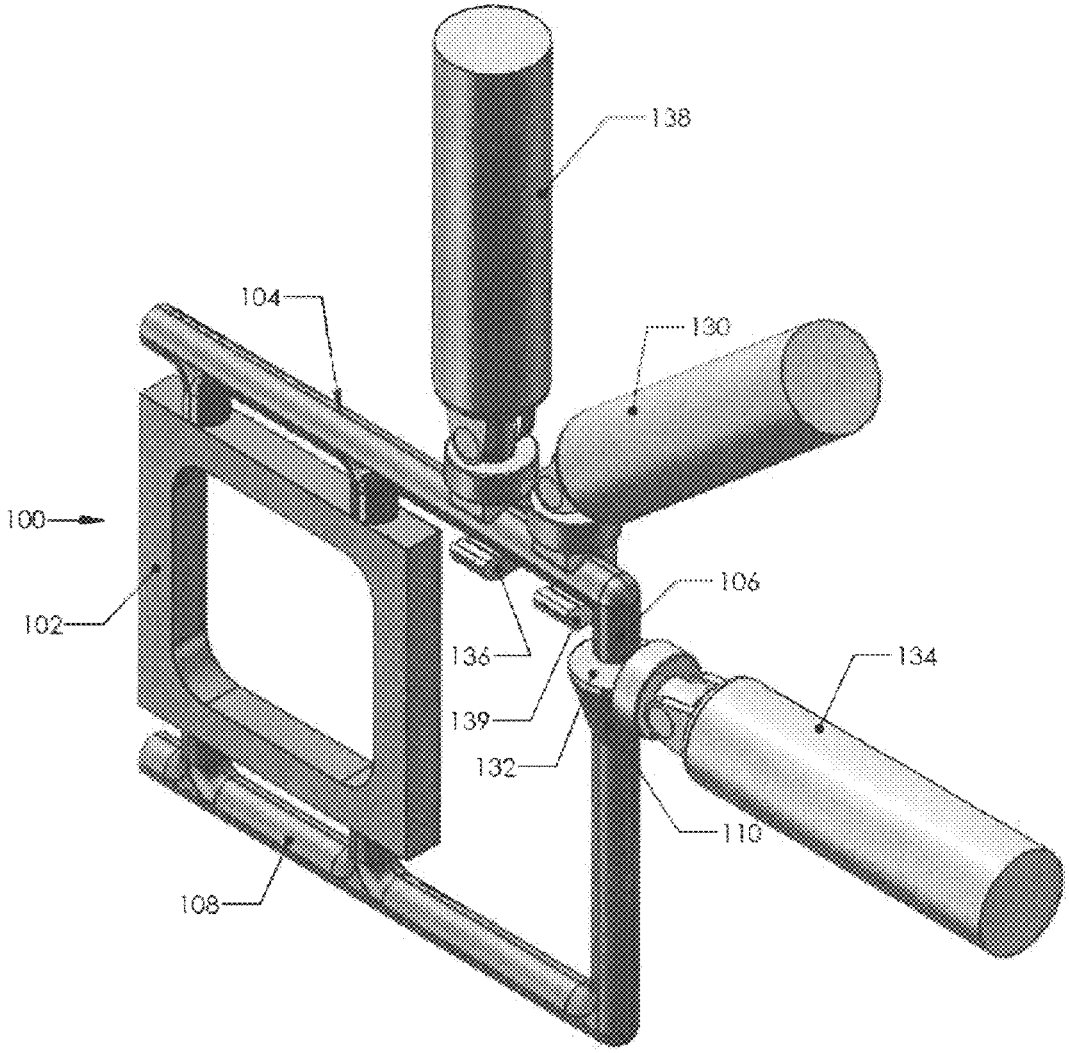
FIG. 4B depicts an isometric view of the wax tree of FIG. 1, where a robot has inserted a heating element between the disconnected sections of the wax tree.

Referring now to FIGS. 4A and 4B, an alternative embodiment of wax tree 100 and system for assembly of the same is shown. In this embodiment, disconnected section 106 and disconnected section 110 are in proximity, but are not in contact, with one another. Disconnected section 106 and disconnected section 110 may have been placed in the position manually, or by automated equipment 130. Wax tree 100 has not been damaged by automated equipment 130 or manual manipulation required to bring wax runner 104, wax runner 108 and wax pattern 102 into proximity with one another. One or both of disconnected section 106 and disconnected section 110 may then be heated, preferably, using heating element 132, which is controlled by automated equipment such as robot 134. Shown in FIGS. 4A and 4B, robot 134 manipulates a heating element 132 such as a heated blade in between disconnected sections 106 and 110 to heat the ends of disconnected sections 106 and the end of disconnected section 112, which are facing one another. In an alternative embodiment disconnected section 106 and disconnected section 110 may both be heated at the ends thereof. Heating element 132 may be disposed by automated equipment 134 between disconnected section 110 and disconnected section 106 to perform the heating step.

Figure 5:
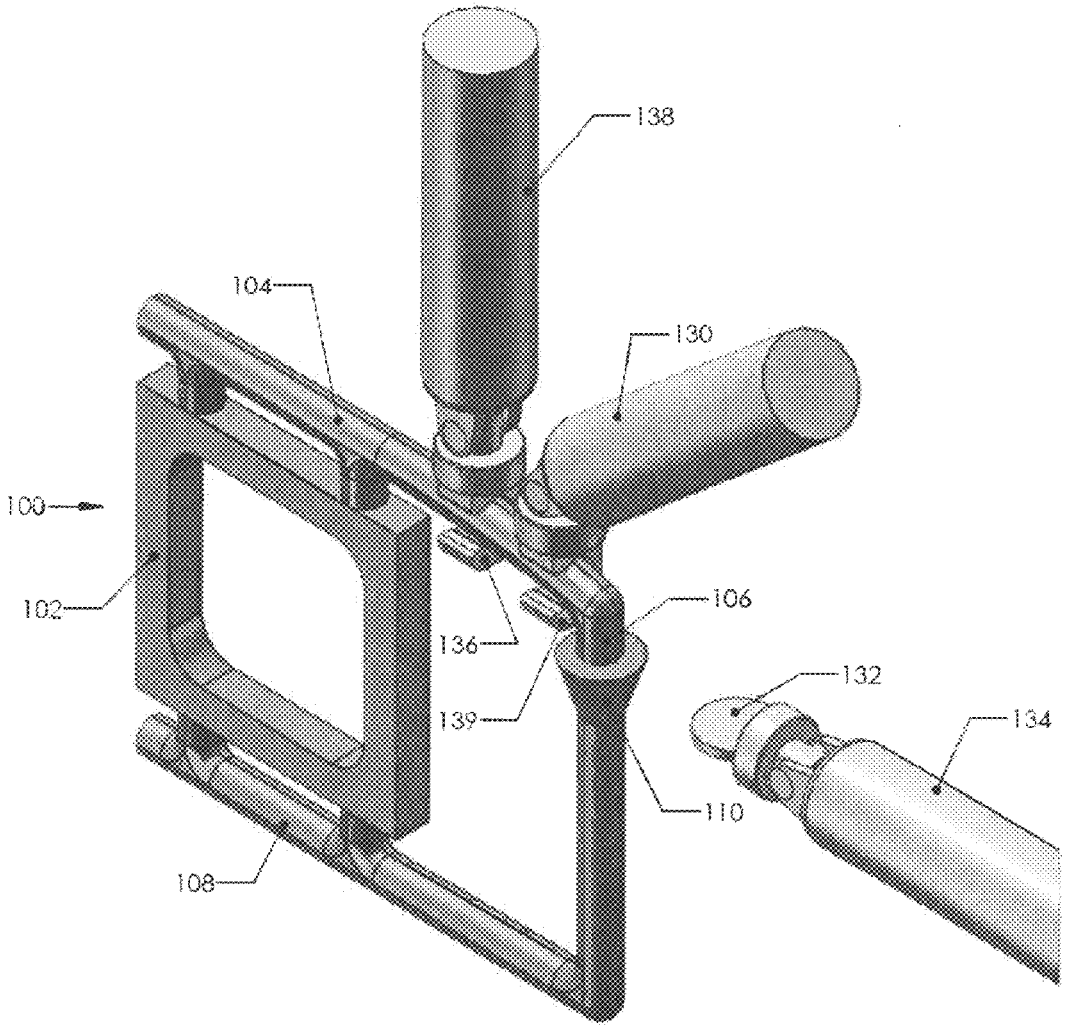
FIG. 5 depicts the wax tree of FIG. 4A, where the wax runner has been flexed and the disconnected sections have been brought in contact with one another, in accordance with an aspect of the invention.

As shown in FIG. 5, wax runner 104 may then be flexed, through bending and/or stretching to bring disconnected section 106 towards and into contact with disconnected section 110. Wax tree 100 is not damaged as wax runner 104 is flexed. Wax runner 104 may be heated by heating element 136 before and/or during the flexing. One or more heating elements 136 may be adjacent to wax runner 104, wax runner 108, and/or wax pattern 102. The flexing may be achieved manually, or, more preferably, by manipulation with automated equipment such as robot 130. Robot 130 may include grippers 139 to manipulate the wax runner 104 to bring disconnected sections 106 and 110 in contact with one another. Heating element 136 is connected to automated equipment such as robot 138, which manipulates heating element 136 into proximately with wax runner 104 at the specific location where the wax runner 104 is flexed, preferably by either bending and/or stretching. Automated equipment may comprise a linear actuator 134, or a robotic mechanism or another mechanism which translates or manipulates heating element 132 between disconnected sections 106 and 110 to heat one or both of the respective ends thereof. It should be understood that flexing wax runner 104 occurs quickly enough so that disconnected section 106 and/or disconnected section 110 is still molten, but slowly enough so that wax tree 100 is not damaged. Heating, before and/or during flexing, by one or more heating elements 136 may also prevent any damage to wax tree 100.

Figure 6:
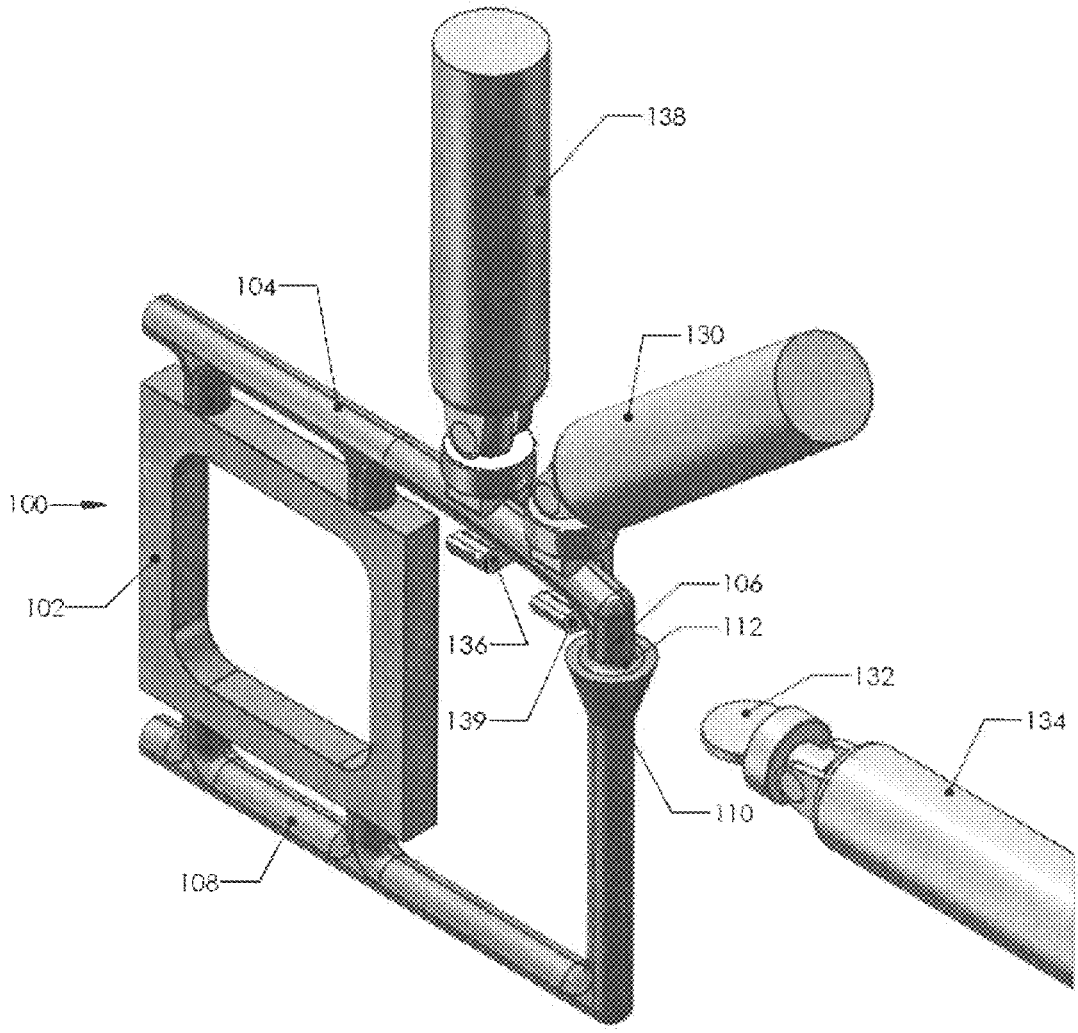
FIG. 6 depicts the wax tree of FIG. 4A, where the disconnected sections have been connected and then have been moved slightly away from one another, in accordance with an aspect of the invention.

As shown in FIG. 6, disconnected section 106 and wax runner 104 may be moved away from disconnected section 110 slightly, so as to create fillet weld 112, by robot 130. The process of creating weld 112 is described more fully above, and the description should be understood to apply to this embodiment as well.

Still referring to FIG. 6, robot 130 may be used to move disconnected section 106 slightly away from disconnected section 110. Disconnected section 106 may be moved before the previously heated portion of disconnected section 110 and/or disconnected section 106 cools and solidifies completely. One or more heating element 136 may heat wax runner 104, wax runner 108, and/or wax pattern 102 as flexing occurs. As disconnected section 106 and/or disconnected section 110 cool, weld 112, which may be a fillet weld, is formed. Wax runner 104 may be in a position, as shown in FIG. 6, that is different from the position of wax runner 104 before weld 112 was formed, as shown in FIG. 4. Thus, flexing of wax runner 104 may change the shape of wax tree 100.

Figure 7A:
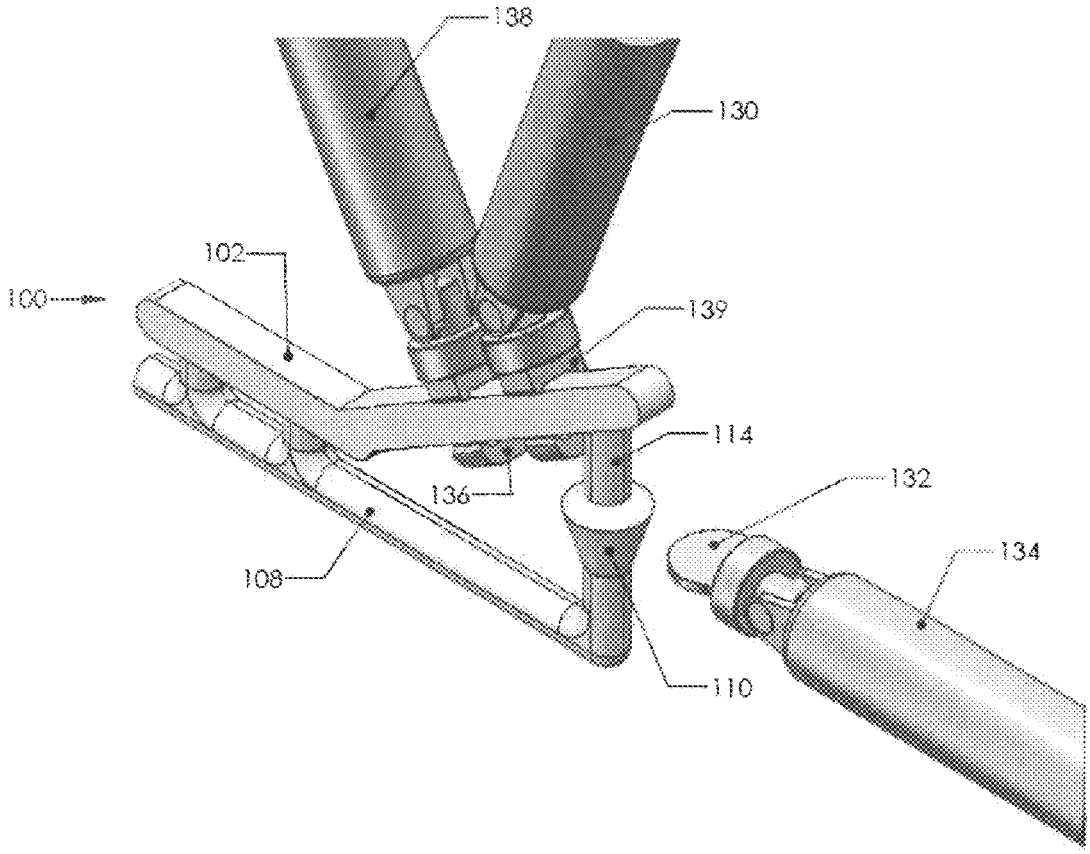
FIG. 7A depicts an isometric view of another embodiment of a wax tree, where disconnected sections are in proximity but are not in contact with one another, in accordance with an aspect of the invention.

Referring now to FIG. 7A-9, an alternative embodiment of the invention is shown where wax pattern 102 is flexed. Referring specifically to FIGS. 7A and 7B, wax tree 100 is shown having a wax pattern 102 that includes a disconnected section 114, and a second wax runner 108 with a disconnected section 110. Disconnected section 110 and disconnected section 114 may be brought into proximity by hand or by using automated equipment such as robot 130. Robot 130 flexes wax pattern 102 without damaging wax tree 100. The flexing of wax pattern 102 may be accomplished in the same manner as the flexing of wax runner 104 described in the embodiments above.

Figure 7B:
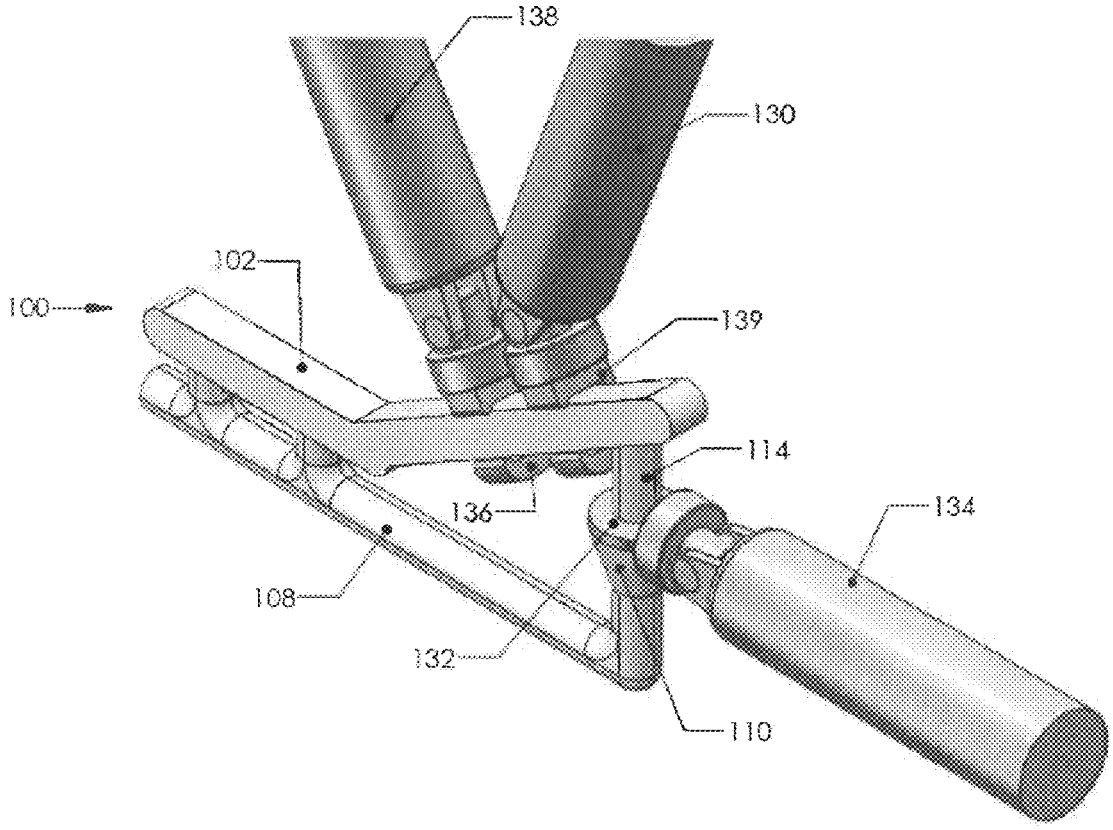
FIG. 7B depicts an isometric view of the wax tree of FIG. 1, where a robot has inserted a heating element between the disconnected sections of the wax tree.

Still referring to FIGS. 7A and 7B, heating element 132, manipulated by linear actuator 134, is shown disposed between disconnected section 114 and disconnected section 110. Heating element 132 may be used to heat disconnected section 114 and/or disconnected section 110. After the heating has been performed, heating element 132 may be withdrawn from wax tree 100 manually, or, more preferably, by linear actuator 134. Wax pattern 102 and disconnected section 114 may then be manipulated, by robot 130. In manipulating wax tree 100, wax pattern 102 is flexed, namely, bent and/or stretched so that disconnected sections 114 and 110 come into contact with each other. Wax pattern 102 may be heated before and/or during the step of manipulating (to facilitate flexing of the wax pattern) by one or more heating elements 136. Each heating element 136 may be manipulated by robot 138.

Figure 8:
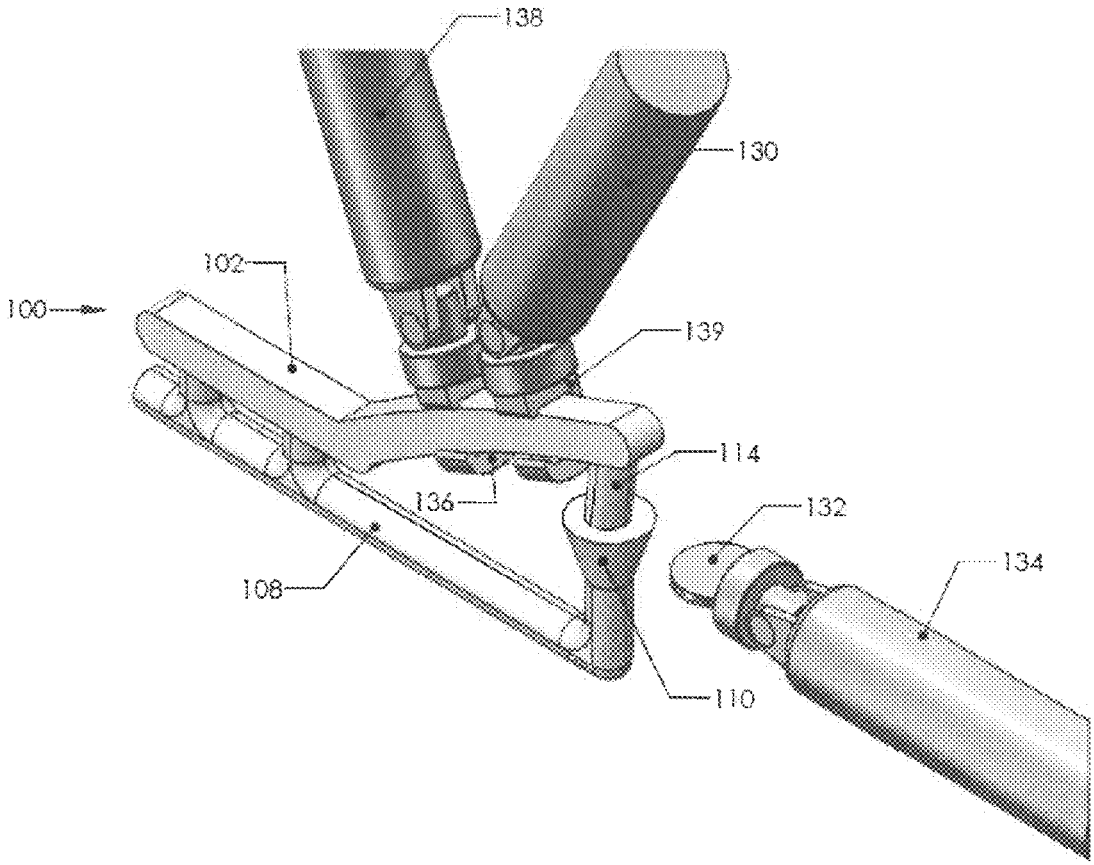
FIG. 8 depicts the wax tree of FIG. 7A, where a wax pattern has been flexed and the disconnected sections have been brought in contact with one another, in accordance with an aspect of the invention.

Referring now to FIG. 8, wax pattern 102 has been flexed such that disconnected section 114 has been brought into contact with disconnected section 110 of wax runner 108. The flexing of wax pattern 102 may have been a bending, flexing or both. The flexing of wax pattern 102 is achieved preferably using robot 130. Heating element 136, manipulated by robot 138, may heat wax pattern 102 and/or wax runner 108 such that when wax pattern 102 is flexed, no damage occurs to wax tree 100. After heating element 132 has been removed, but before disconnected section 114 and/or disconnected section 110 has cooled, automated equipment 130 may flex wax pattern 102 such that disconnected section 114 and disconnected section 110 are brought into contact. The disconnected sections are brought into contact at their respective opposed surface which face each other.

Figure 9:
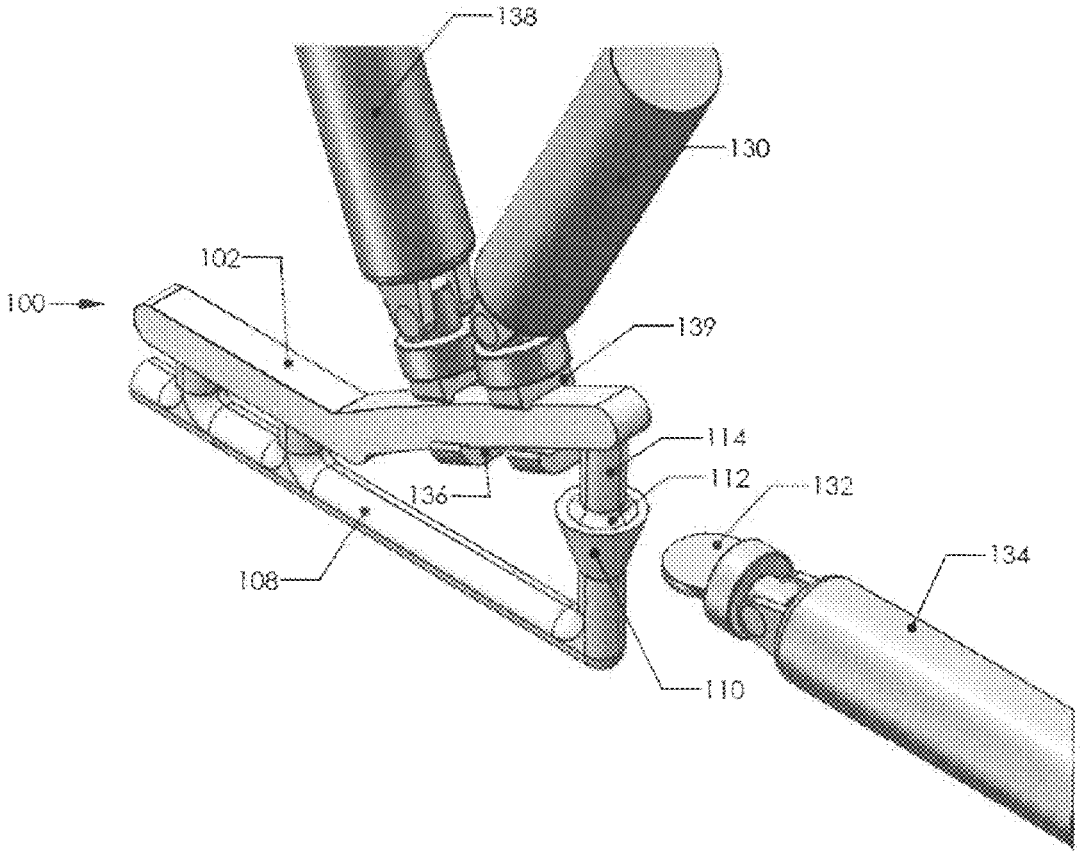
FIG. 9 depicts the wax tree of FIG. 7A, where the disconnected sections have been connected and then have been moved slightly away from one another to create a filet weld, in accordance with an aspect of the invention.

Referring now to FIG. 9, disconnected section 114 has been moved slightly away from disconnected section 110, thereby forming weld 112. Weld 112 is described more fully in the embodiments above. Disconnected section 114 may be moved away from disconnected section 110 manually, or more preferably, with robot 130. Wax pattern 102 may be heated by one or more heating elements 136 before and/or during the flexing step, and, if necessary, when disconnected section 114 is moved away from disconnected section 110. Heating wax pattern 102 may prevent damage to wax tree 100. Wax tree 100 may then be allowed to cool. The wax tree may be thereafter used to cast a part similar to the wax pattern.

The flexing of wax pattern 102 may slightly change or vary the shape of wax pattern 102. As shown in FIG. 9, wax pattern 102 is not identical to the wax pattern 102 of FIG. 7, which shows wax pattern 102 before any flexing for the purpose of creating weld 112 has occurred. Thus, wax pattern 102 may be altered, or placed in a more preferable position to form weld 112. Also, wax pattern 102 may be returned to its original shape after it has been flexed; thus, flexing may have no effect on the final shape of wax pattern 102.

Figure 10:
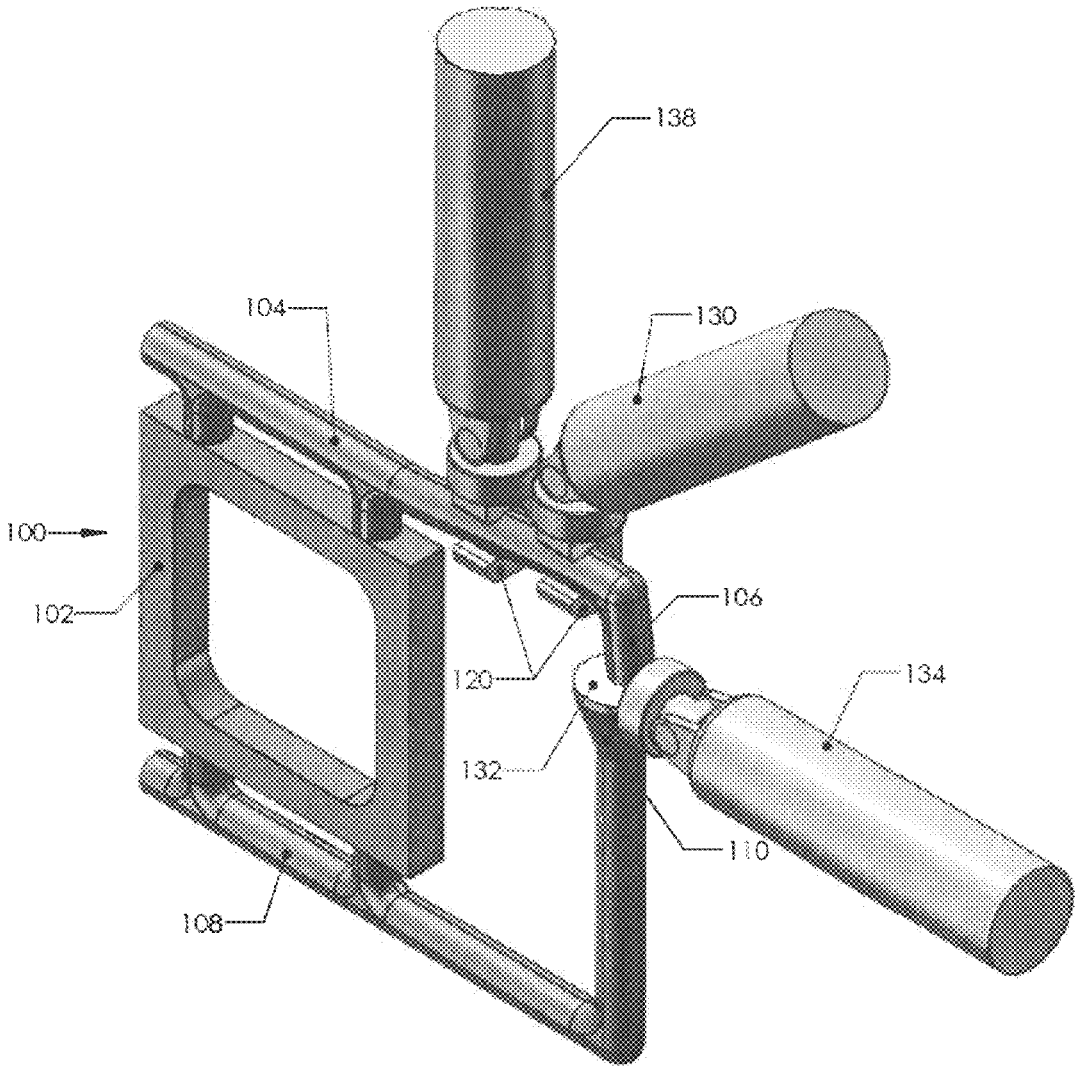
FIG. 10 depicts an isometric view of a wax tree, where the wax tree includes one or more wax holders and a heating element, in accordance with an aspect of the invention.

Referring now to FIG. 10, an alternative embodiment of wax tree 100 is shown where first wax runner 104 is shown with one or more wax holders 120. One or more wax holders 120 may be heated to make wax runner 104 elastic and complaint to facilitate flexing of wax runner 104, including stretching and/or bending. Heating wax runner 104 using the heated wax holders 120 before flexing the runner may prevent damage from being caused to wax tree 100. Use of heated wax holders may be used in any of the embodiments of the invention set forth herein and may be used to hold any section of the wax tree including the wax pattern or wax runner. The heated wax holders may alleviate the necessity for separate heating elements operated by separate pieces of automated equipment such as separate robots. The heated wax holders 120, or any other heating element described in the embodiments depicted herein, provide enough heat to allow for flexing of the sections of the wax tree, such as a wax pattern or wax runner, without damaging wax tree and preferably without altering the shape or configuration of the wax tree such a way which impedes the performance of the lost wax process used to create a casting.

Figure 11:
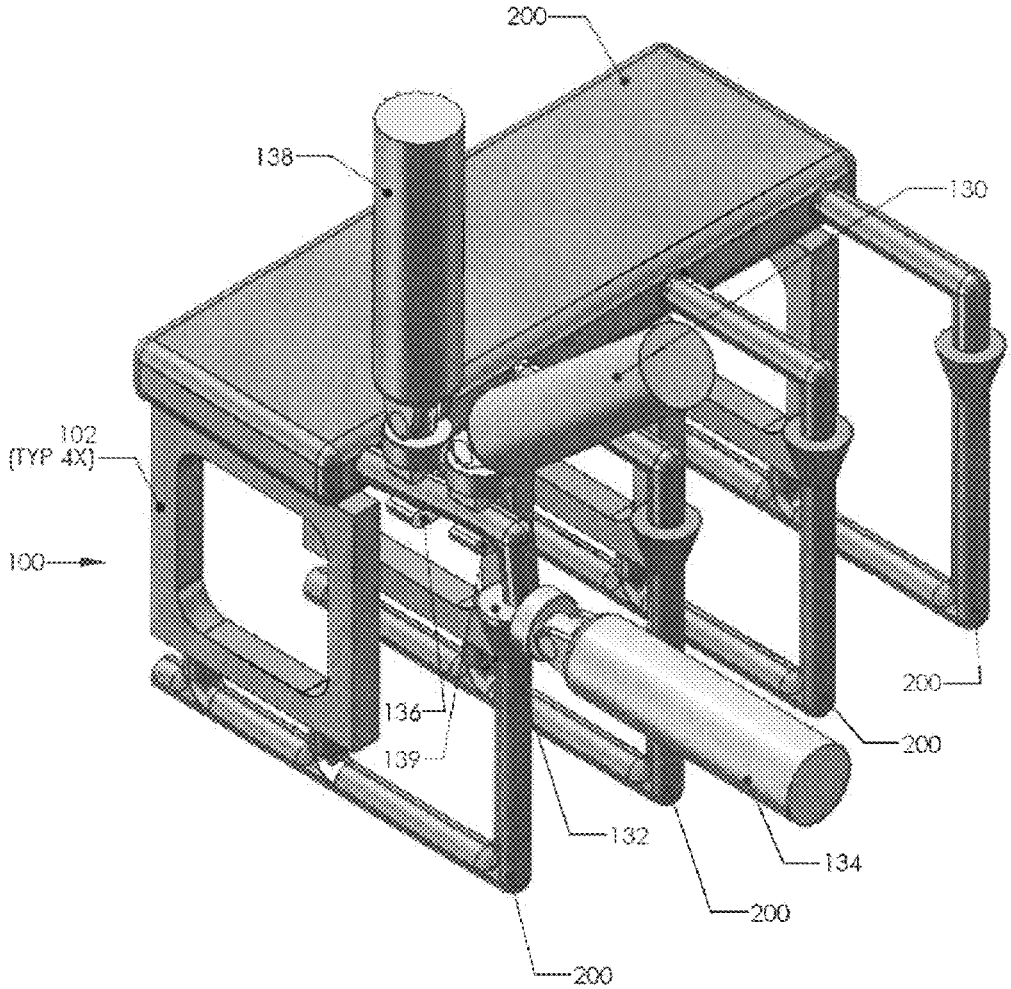
FIG. 11 depicts an isometric view of a wax tree having multiple wax patterns, in accordance with an aspect of the invention.
Figure 12:
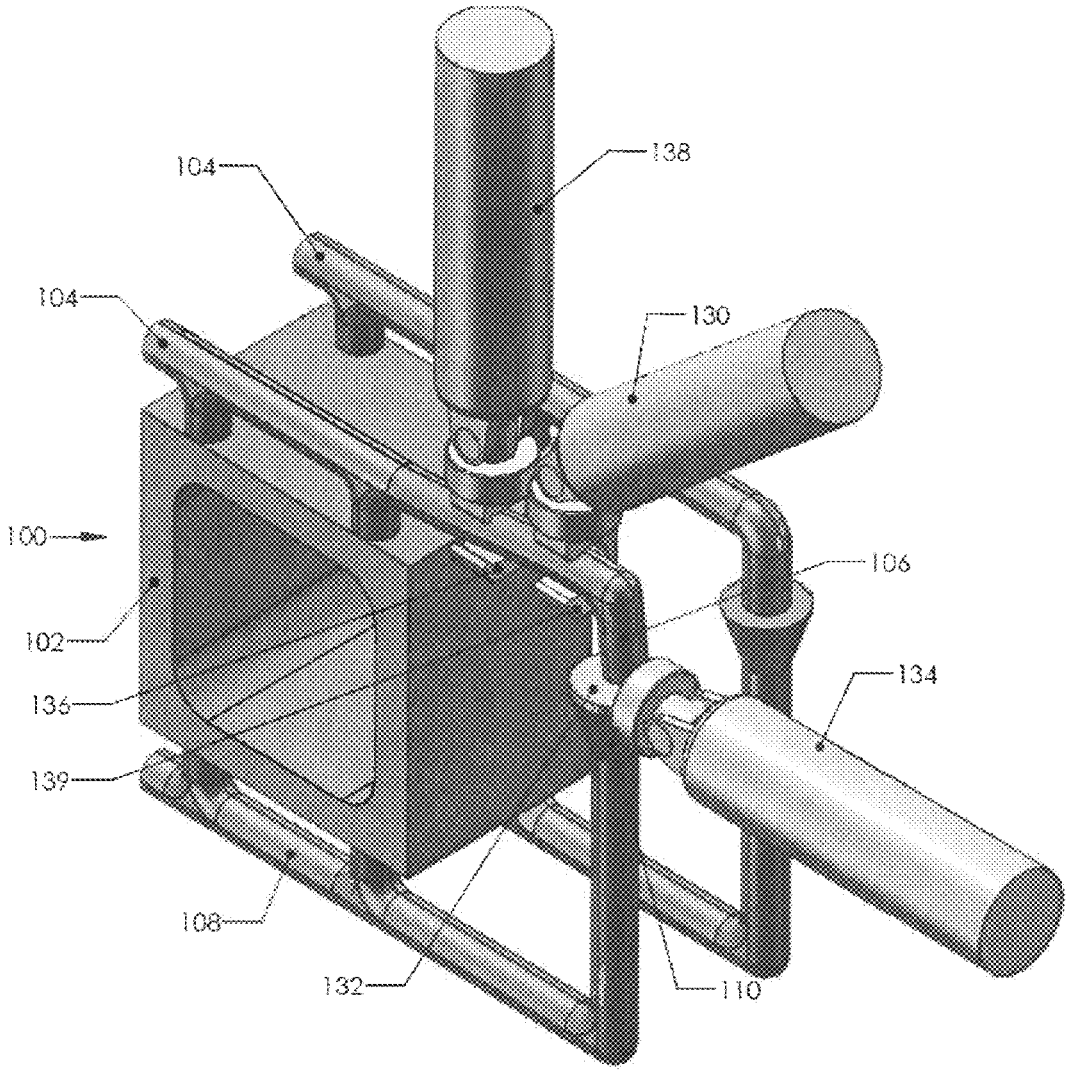
FIG. 12 depicts an isometric view of a wax tree having a single wax pattern and the multiple wax runner sections.

Although reference has been made above in FIGS. 1-10 to wax tree 100 including wax pattern 102 and first wax runner 104 and second wax runner 108, it is contemplated that more complex wax trees may be constructed consisting of one or more wax runners and one or more wax patterns. For example, a more complex wax tree 100 is shown in FIG. 11 having one or more wax patterns 102 and wax runner 200. In addition, a more complex wax tree having a single wax pattern 102, but multiple wax runners is shown. As shown by FIG. 11, a single wax tree 100 may have more than one wax pattern 102. It should be understood that a wax patterns 102 could be complex, depending on the number of parts to be cast, and wax patterns 102 shown in FIG. 11 and FIG. 12 are only shown for example purposes. Also shown in FIG. 11, is wax runner 200 having multiple sections. It is contemplated that one or more wax runner sections 200 or one or more wax patterns 102 may be heated and subsequently and/or simultaneously flexed in order to change the overall shape and structure of wax tree 100 as described in the embodiments above. Single or multiple pieces of automated equipment may be used for the assembly of each wax tree including one of robots and heating elements. For example, robot 130 having grippers 139 may be used to assemble the entire wax tree 100 and facilitate flexing of the wax runner sections 200 and/or wax patterns 102. Also, robot 138 may manipulate heating elements 136 which softens by melting sections of the wax runner 200 or wax patterns 102 to be flexed as well as the ends of disconnected sections which are connected by robot 130 during assembly of the wax tree. After the wax tree (shown in the embodiment herein) has been assembled, the wax tree may then be covered with a mold material such as ceramic. The wax tree may then be removed from the mold material by melting to create a mold. The mold may later be used to cast one or more part, for example, a metal part, that is similar to the wax patterns.

While embodiments of the invention have been illustrated and described in detail in the disclosure, the disclosure is to be considered as illustrative and not restrictive in character. All changes and modifications that come within the spirit of the invention are to be considered within the scope of the disclosure.

What is claimed is:

1. A process for creating a lost wax tree comprising:

assembling a wax tree having at least a wax pattern of said part and a wax runner;

using automated equipment to flex at least one of said wax pattern and said wax runner to bring disconnected sections of said wax tree into proximity with each other without damaging said wax tree;

heating at least one of said disconnected sections;

contacting said disconnected sections after heating and then moving said disconnected sections slightly away from one another.

2. The process of claim 1 wherein said flexing step comprises flexing a wax runner.

3. The process of claim 1 wherein said flexing step comprises flexing a wax pattern.

4. The process of claim 1 wherein said flexing step comprises at least one of bending and stretching.

5. The process of claim 1 wherein said heating step is performed using automated equipment.

6. The process of claim 4 wherein said heating step comprises heating at least one of said disconnected sections to soften at least one of said wax pattern and said wax runner to allow said flexing to occur at the softened sections.

7. The process of claim 1 wherein said heating step comprises heating ends of said disconnected sections and contacting said heated ends together to assemble said wax tree.

8. The process of claim 1 wherein said contacting and moving steps are performed using automated equipment.

9. A process for casting a part using a lost wax tree comprising:

assembling a wax tree having at least a wax pattern of said part and a wax runner;

using automated equipment to flex at least one of said wax pattern and said wax runner to bring disconnected sections of said wax tree into proximity with each other without damaging said wax tree;

heating at least one of said disconnected sections;

contacting said disconnected sections after heating and then moving said disconnected sections slightly away from one another;

wherein said wax tree is later covered with a mold material and said wax tree is removed from said mold material to create a mold, said mold being later used to cast a part similar to said wax pattern.

10. The process of claim 9 wherein said flexing step comprises flexing a wax runner.

11. The process of claim 9 wherein said flexing step comprises flexing a wax pattern.

12. The process of claim 9 wherein said flexing step comprises at least one of bending and stretching.

13. The process of claim 9 wherein said heating step is performed using automated equipment.

14. The process of claim 12 wherein said heating step comprises heating at least one of said disconnected sections to soften at least one of said wax pattern and said wax runner to allow said flexing to occur at the softened sections.

15. The process of claim 9 wherein said heating step comprises heating ends of said disconnected sections and contacting said heated ends together to assemble said wax tree.

16. The process of claim 9 wherein said contacting and moving steps are performed using automated equipment.

17. A lost wax tree system comprising:

a wax tree having at least a wax pattern of a part to be cast and a wax runner;

automated equipment means for flexing at least one of said wax pattern and said wax runner to bring disconnected sections of said wax tree into proximity with each other without damaging said wax tree;

a heating element oriented to heat at least one of said disconnected sections;

automated equipment means for contacting said disconnected sections after heating and then moving said disconnected sections slightly away from one another to assemble said wax tree.

18. The system of claim 17 wherein said automated equipment means for flexing flexes a wax runner.

19. The system of claim 17 wherein said automated equipment means for flexing flexes a wax pattern.

20. The system of claim 17 wherein said automated equipment means for flexing and said automated equipment means for contacting comprises a robot.

* * * * *